US005584729A

United States Patent [19]

Luu

[11] Patent Number: 5,584,729

[45] **Date of Patent: *Dec. 17, 1996**

[54] ELECTRICAL OUTLET ADAPTER

[75] Inventor: Lionel T. V. Luu, Hong Kong, Hong Kong

[73] Assignee: Pacusma Co., Ltd., Hong Kong, Hong Kong

[ * ] Notice: The term of this patent shall not extend beyond the expiration date of Pat. No. 5,281,172.

[21] Appl. No.: 279,153

[22] Filed: Jul. 22, 1994

[51] Int. Cl.[6] ..... H01R 25/00

[52] U.S. Cl. ..... 439/652

[58] Field of Search ..... 439/650–652

[56] References Cited

U.S. PATENT DOCUMENTS

| | | | |
|---|---|---|---|
| 5,094,630 | 3/1992 | Jammet | 439/652 |
| 5,122,082 | 6/1992 | Lee | 439/652 |
| 5,211,584 | 5/1993 | Lee | 439/652 |
| 5,232,381 | 8/1993 | Yu | 439/652 |
| 5,281,172 | 1/1994 | Luu | 439/651 |

*Primary Examiner*—P. Austin Bradley
*Assistant Examiner*—Jill Demello
*Attorney, Agent, or Firm*—Ostrolenk, Faber, Gerb & Soffen, LLP

[57] ABSTRACT

An adapter for converting a single electrical outlet into a multiple electrical outlet. The adapter includes a housing having a front and a back, and two opposed sides extending between the front and back. Each of the sides of the adapter includes a pod having at least one electrical socket. Electrically conductive live and neutral buses are mounted within in the housing. The live and neutral buses each include respective prongs capable of being inserted into an electrical outlet. The live and neutral buses also each include a pair of electrically conductive strips, each supported by a respective one of the pods, such that a live and neutral strip extends along each of the two opposed sides of the adapter, adjacent the sockets, to electrically conductively engage the live and neutral prongs of electrical devices inserted into the sockets. A ground bus, including a ground prong capable of being inserted into an electrical outlet, and including ground strips supported by each of the pods for engaging the ground prong of an electrical device, may also be provided.

19 Claims, 4 Drawing Sheets

FIG. 2
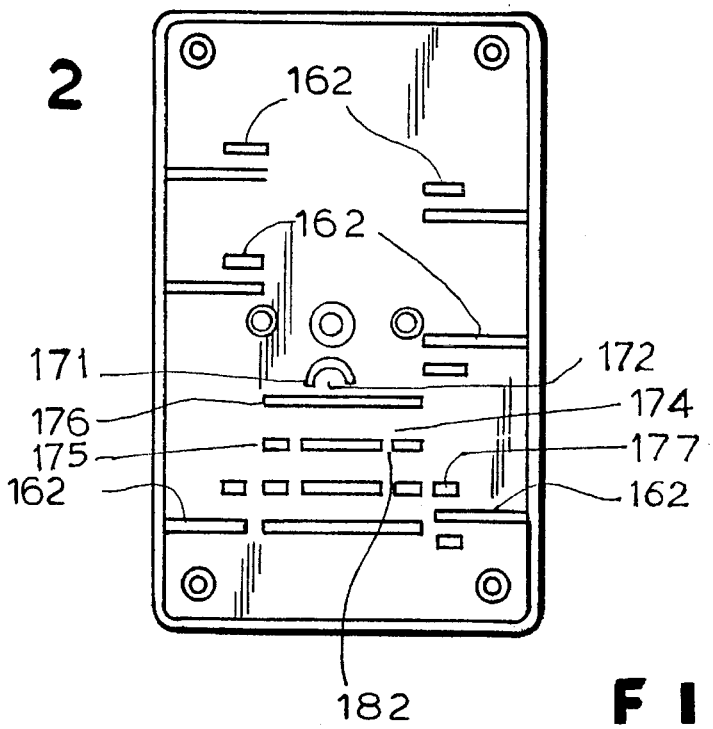
FIG. 3
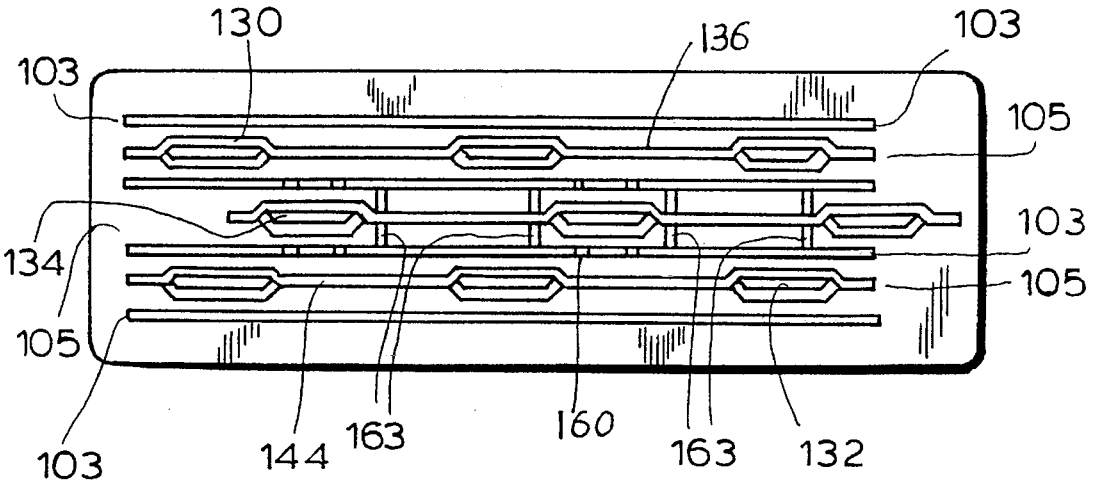
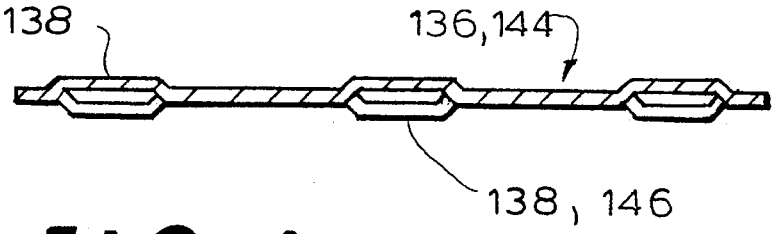
FIG. 4

FIG. 5
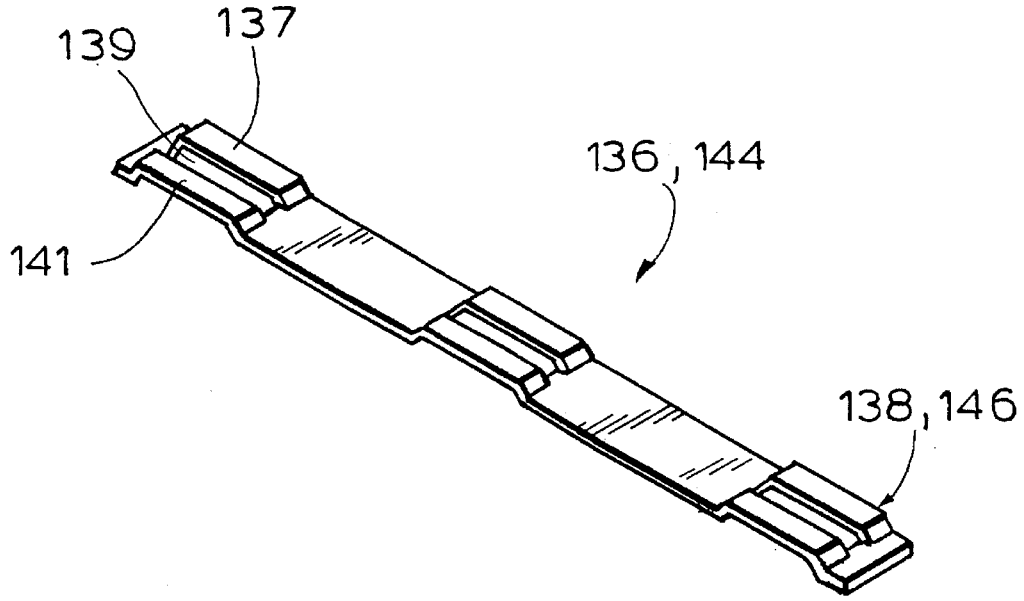
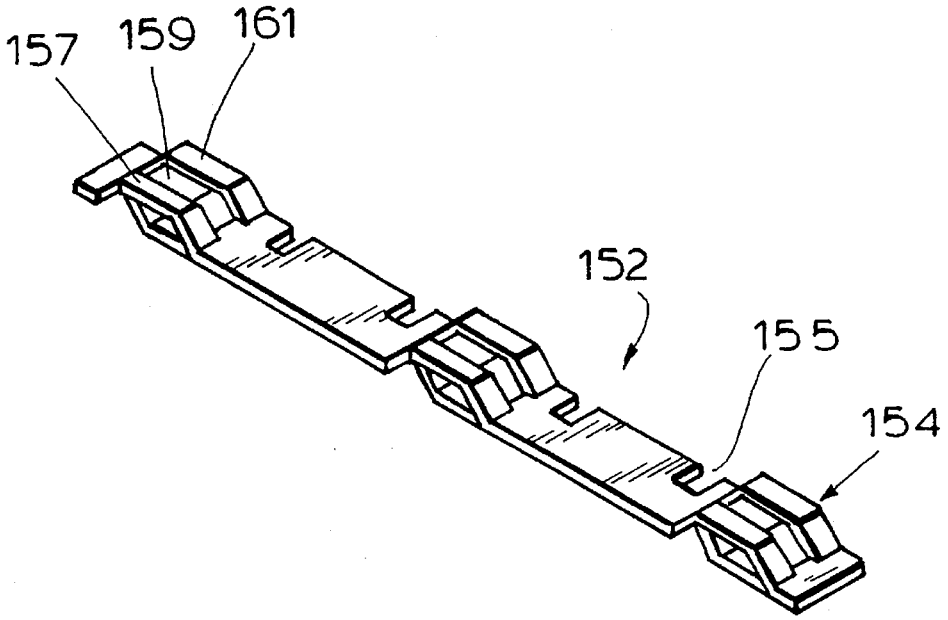
FIG. 6

ELECTRICAL OUTLET ADAPTER

RELATED APPLICATIONS

This is related to U.S. application Ser. No. 07/985,688, filed Dec. 4, 1992, now U.S. Pat. No. 5,281,172.

BACKGROUND OF THE INVENTION

1. Field of the Invention

The present invention relates to an adapter for converting a single electrical outlet or current tap to a multiple electrical outlet, such as those used in household and light commercial and industrial applications.

2. Description of the Prior Art

A number of different types of single-to-multiple electrical outlet adapters or current taps are known. There are, for example, the current taps illustrated and described in U.S. Pat. Nos: 2,792,561; 2,702,893; 3,061,716; 3,997,225; 4,085,996; 4,934,962; 2,706,225; 3,484,735; 3,525,971; Re. 34,532 and 5,122,082.

In a tap of the type illustrated in U.S. Pat. Nos. Re. 34,532 and 5,122,082, the electrical contacts are formed by pods assembled in the housing or on the back plate. Each pod contains multiple contact strips which must be individually wired with the appropriate prong. Moreover, each strip must include a contact blade located in the pod to facilitate electrical connection. The assembly operation includes several soldering operations and numerous other operations involving the correct placement of subassemblies into the current tap housing before and during final assembly. As a result, the labor cost associated with manufacturing such taps is relatively high. This assembly cost is associated with each tap, making the purchase price of such taps higher than it would be if another suitable design could be developed.

SUMMARY OF THE INVENTION

It is an object of the present invention to provide a multiple outlet electrical adapter having components which are quickly and easily assembled in the housing, with minimal connection points, thus avoiding high assembly costs.

Another object of the present invention is to minimize the amount of material used to produce the live, neutral and ground bus strips. Yet another object of the present invention is to provide a configuration for an electrical adapter with sufficient spacing between strips to avoid the need for insulating material.

According to the present invention, an adapter for converting a single electrical outlet into a multiple electrical outlet comprises a housing having a front and a back, and two opposed sides extending between the front and back. A pod is positioned in the housing along one of the opposed sides. A second pod may be positioned in the housing along the second of the two sides. Each of the pods includes at least one electrical socket. Each socket includes a live prong receiving aperture and a neutral prong receiving aperture.

An electrically conductive live bus is mounted in the housing and includes a first live prong capable of being inserted into a live aperture of an electrical outlet receptacle. The live bus also includes a pair of electrically conductive live bus strips, each of which is supported by a respective one of the pods, so that the strips extend along the two opposed sides of the adapter adjacent the live prong receiving apertures of the sockets, to electrically conductively engage live prongs of electrical devices inserted into the sockets.

An electrically conductive neutral bus is mounted in the housing and includes a first neutral prong capable of being inserted into a neutral aperture of an electrical outlet receptacle. The neutral bus also includes a pair of electrically conductive neutral bus strips, each of which is supported by a respective one of the pods, so that the strips extend along the two opposed sides of the adapter adjacent the neutral prong receiving apertures of the sockets, to electrically conductively engage neutral prongs of electrical devices inserted into the sockets.

Advantageously, the live and neutral bus strips are each formed of a single piece of metal, preferably brass/copper, in a configuration which minimizes the amount of metal and the number of connection points required.

Additionally, advantageously, the live and neutral strips are configured such that the first live prong and first neutral prong are properly aligned to fit into an electrical outlet, but the strips are offset vertically so as to maintain sufficient clearance to avoid the need for electrical insulation.

Other features and advantages of the present invention will become apparent from the following description of the invention which refers to the accompanying drawings.

BRIEF DESCRIPTION OF THE DRAWINGS

FIG. 2 illustrates a top view of the inside of the housing front illustrated in FIG. 1;

FIG. 3 illustrates a side view of a pod, showing the relative positions of the live, neutral, and ground bus strips of the adapter of the present invention;

FIG. 4 illustrates a side view of the first live/neutral bus strips of the adapter of FIG. 1;

FIG. 5 is a perspective view of the first live/neutral bus strips of the adapter of FIG. 1;

FIG. 6 is a perspective view of the first ground bus strip of the adapter of FIG. 1;

DETAILED DESCRIPTION OF THE INVENTION

Figure 1:
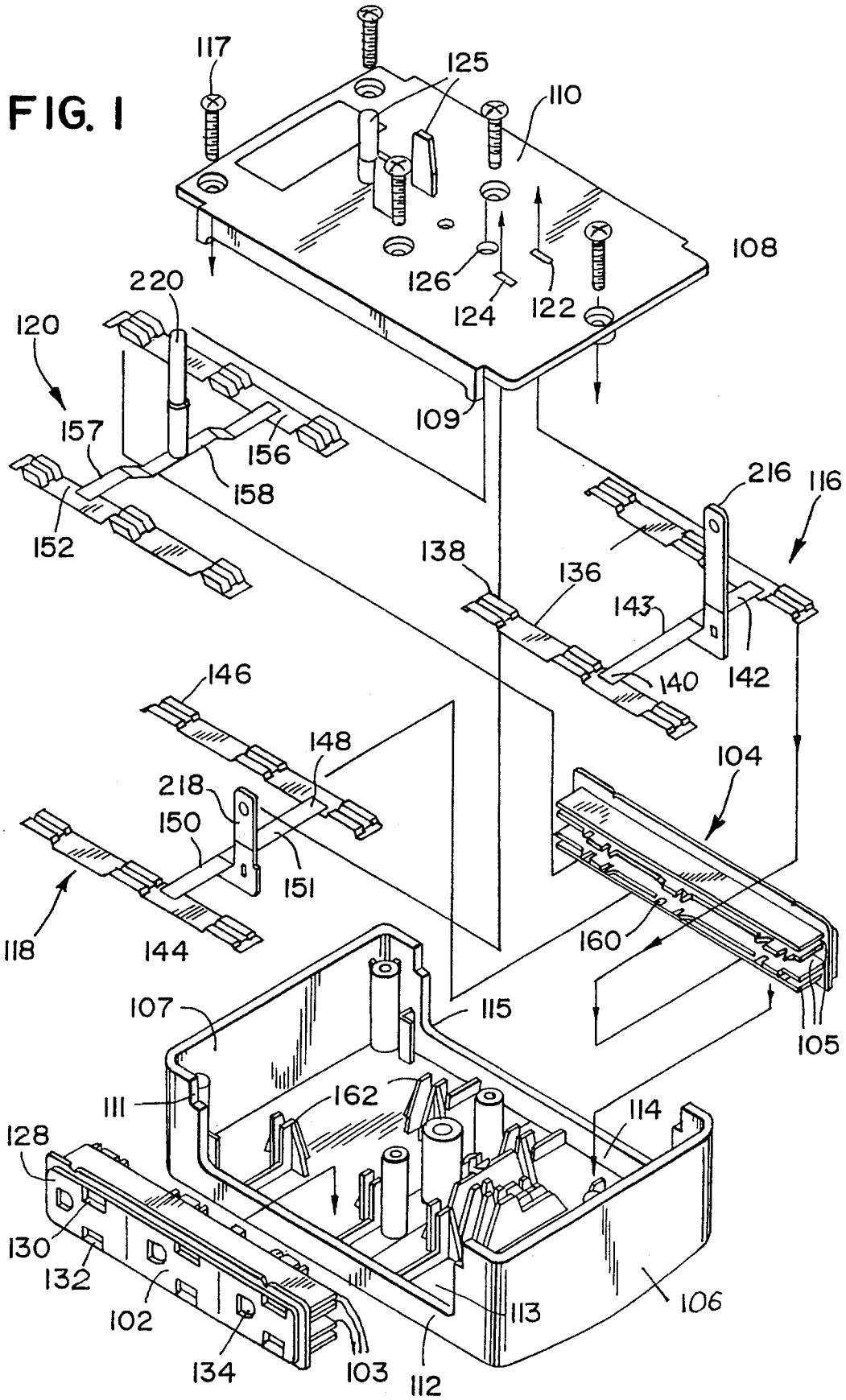
FIG. 1 illustrates a perspective view of a single-to-multiple electrical outlet adapter constructed according to a preferred embodiment of the present invention.

In its preferred embodiment, the present invention, a single-to-multiple electrical outlet adapter or tap, includes a housing having a front 106, the inside 107 of which is presented to the viewer in FIG. 1. A back 108, having an outer surface 110 and two sides 112, 114, is also shown in FIG. 1.

Adapter 100 includes a live bus assembly 116, a neutral bus assembly 118 and a ground bus assembly 120. Each of the live, neutral and ground bus assemblies 116, 118, 120, respectively, include a prong configured for passage through an opening 122, 124, 126, respectively, provided therefor on back 108 for plugging into an electrical outlet, such as a residential 110 VAC, 60 Hz outlet. Live bus assembly 116 includes a live prong 216, neutral bus assembly 118 includes prong 218 and ground bus assembly 120 includes a ground prong 220.

Each of the sides 112, 114 is provided with a cut-out portion 113,115. Each cut-out portion 113, 115 receives a respective pod 102, 104 fixed therein. Pods 102, 104 are comprised of an electrically insulative material and include a plurality of tabs 103 spaced from each other on an inner surface of the pods. The tabs 103 define lower, upper and middle longitudinal slots 105 therebetween. When pods 102, 104 are assembled in cut-out portions 113, 115, respectively, tabs 103 extend toward the inside 107 of the housing.

Each pod includes a plurality of outwardly facing sockets 128, with three such sockets being illustrated in FIG. 1. Each socket 128 includes a live prong-receiving aperture 130, a neutral prong-receiving aperture 132 and a ground prong-receiving aperture 134.

The live bus assembly 116 comprises a pair of respective electrically conductive first live bus strips 136, stamped from a sheet of electrically conductive material, typically a resilient brass/copper alloy. The strips are configured to minimize the amount of wasted metal.

As shown in FIGS. 1, 4 and 5, a plurality of sets of ribs 138 are disposed along the length of the first live bus strips 136 at spaced locations corresponding to the live-prong receiving apertures 130. At each location, three ribs 137, 139 and 141 are provided, the two outer ribs 137 and 141 being bent upward and the middle rib 139 bent downward. The ribs 138 are bent so as to form grippers which securely grip the live prongs of appliances and the like inserted between the ribs into the live prong-receiving apertures 130.

Figure 8:
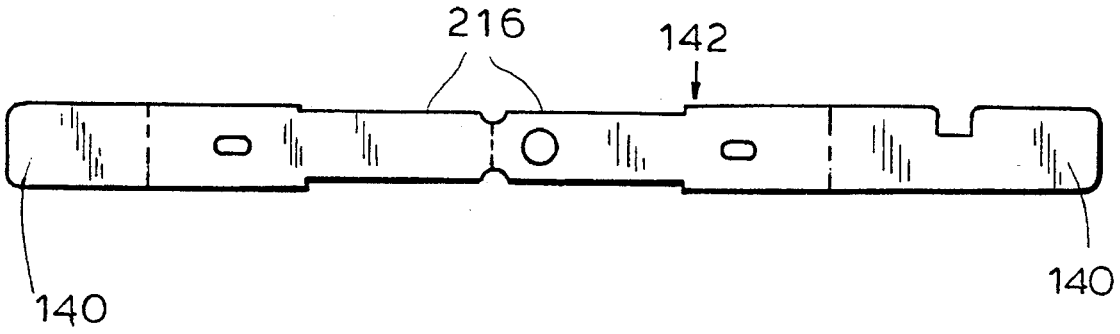
FIG. 8 illustrates a profile of a flat strip which can be formed into the live prong or second live strip of the adapter of FIG. 1.

The two electrically conductive first live bus strips 136 are joined together, for example, by spot welding the strips to the ends 140 of a electrically conductive second live bus strip 142. The profile of the second live bus strip 142, and how it is formed into a component of the live bus assembly 116 can best be appreciated by comparing FIGS. 1 and 8. As can be seen from FIG. 8, strip 142 is stamped from a single piece of brass/copper metal in a configuration which minimizes the wastage of metal and minimizes connection points, as discussed below. During assembly, strip 142 is folded along the dashed lines to form prong 216 and ends 140.

During assembly, each live bus strip 136 is inserted into a longitudinal slot 105 in the pods 102, 104 adjacent each socket 128 in the region directly behind the live prong-receiving aperture 130, to electrically conductively engage a live prong inserted into one of the live prong-receiving apertures 130 to connect the inserted live prong electrically to the live bus assembly 116.

Figure 7:
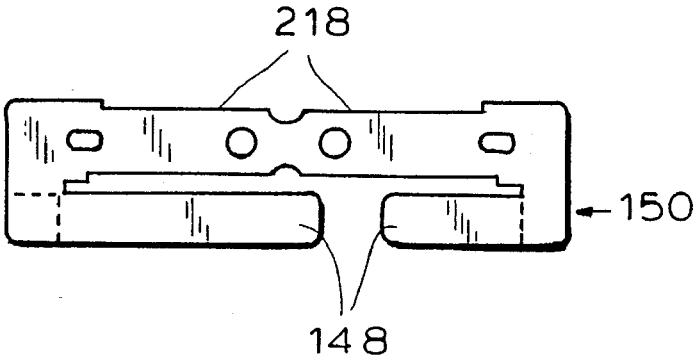
FIG. 7 illustrates a profile of a strip which can be formed into the neutral prong, or second neutral bus strip, of the adapter of FIG. 1.

The neutral bus assembly 118 comprises a pair of electrically conductive first neutral bus strips 144, one strip being disposed in each of the pods to extend along each side 112, 114 of the housing. The two electrically conductive first neutral bus strips 144 are joined about midway along their lengths, for example, by spot welding them to the ends 148 of an electrically conductive second neutral bus strip 150. The profile of the second neutral bus strip 150, and how it is formed into a component of the neutral bus assembly 118 can best be appreciated by comparing FIGS. 1 and 7. As shown in FIG. 7, prong 218 and ends 148 are stamped from a single piece of metal and bent along the dashed lines to form the strip 150. The single piece configuration of the second neutral bus strip 150 minimizes the amount of brass or copper material used to make the strip, greatly decreasing waste, and also advantageously minimizes connection points. Thus, as shown in FIG. 1, each first live strip 136 and each first neutral strip 144 are spot welded to the respective second live bus strip 142 and second neutral strip 150 at a single location.

When assembled, each neutral bus strip 144 is inserted into a longitudinal slot 105 in pods 102, 104, adjacent each socket 128 in the region directly behind the neutral prong-receiving apertures 132, to electrically conductively engage a neutral prong inserted into one of the neutral prong-receiving apertures 132, to connect the inserted .neutral prong electrically to the neutral bus assembly 118. A plurality of sets of ribs 146 are disposed along the length of the first neutral bus strips 144 at spaced locations corresponding to the neutral-prong receiving apertures 132. Like ribs 138 of first live strip 136, the trio of ribs 146 forming each set are stamped from a flat shape, and subsequently bent to form grippers which securely grip the neutral prongs inserted into the neutral prong-receiving apertures 132.

The second live bus strip 142 and the second neutral bus strip 150 are configured such that the respective prongs 216, 218 are aligned with one another when the adapter is assembled. However, the first live and neutral bus strips 136, 144 each lie in a different slot 105 in a different vertical plane (see FIG. 3), to maintain a clearance therebetween, thus avoiding the need for insulating parts.

The ground bus assembly 120 comprises an electrically conductive first ground bus strip 152, disposed in each of the pods 102, 104 and extending along each side 112, 114 of the housing. Each first ground bus strip extends adjacent each of the sockets 128 in the pods, in the region directly behind the ground prong-receiving aperture 134, to electrically conductively engage a ground prong inserted into one of the ground prong-receiving apertures 134, to connect such a prong electrically to the ground bus assembly 120.

As shown in FIG. 6, the first ground bus strips 152 are formed with a plurality of sets of ribs 154 disposed along the length of the first ground bus strips 152 at spaced locations corresponding to the ground prong-receiving apertures 134. As illustrated by FIGS. 1 and 6, the outer ribs 157, 161 are bent upward and the inner rib 154 is bent downward to form the gripping portions. The first ground strips also include slots 155 disposed on the side to be inserted into the pod. The ground strips are received in the longitudinal slots 105 formed between the two tabs 103 having notches 160. As shown in FIG. 3, a plurality of ribs 163 extend between the tabs 103 having notches 160. When strips 152 are inserted into slots 105, slots 155 receive ribs 163 to accurately position the ground strips in the pods. When the strips 136, 144 and 152 are assembled in the pods 102, 104, ground bus strip 152 is offset from live and neutral strips 136, 144 as shown in FIG. 3.

Figure 9:
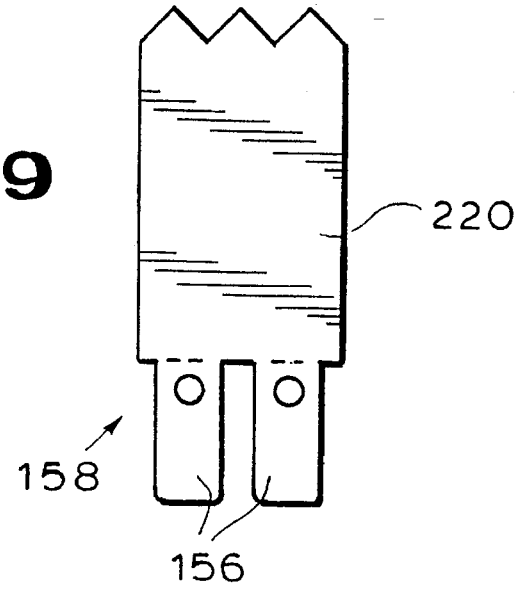
FIG. 9 illustrates a profile of a flat strip which can be formed into the ground prong, or second ground bus strip, of the adapter of FIG. 1.

The two electrically conductive first ground bus strips 152 are joined along their lengths by spot welding them to the ends 156 of an electrically conductive second ground bus strip 158. The profile of the second ground bus strip 158, and how it is formed into a component of the ground bus assembly 120 can best be appreciated by comparing FIGS. 1 and 9. As shown in the Figures, ends 156 are bent along the dash lines and the prong 220 is formed by curving the upper flat section in FIG. 9.

With particular reference now to FIGS. 1 and 2, it will be appreciated that the inside of the front 106 is formed with a plurality of upstanding spacers, guides and retainers to guide the live, neutral and ground bus assemblies 116, 118, 120, held by pods 102, 104, respectively, into their assembled orientations in the adapter, to retain the bus assemblies in these orientations and to position the bus assemblies within the housing 106 in a spaced-apart orientation with each other to maintain insulated electrical integrity therebetween. Four tabs 103 are shown in FIGS. 1 and 3. The two middle tabs (FIG. 1) include the notches 160. For example, three sets of notches 160 are spaced along the two inner tabs. The notches 160 on the lower tabs cooperate with upstanding ribs 162 formed on the inside of the front 106 to guide and position the pods 102, 104 into the front 106 of the housing.

The backbone 143 of second strip 142 of the live bus assembly 116 is press-fitted into a longitudinal slot 174 provided therefor between adjacent upstanding ribs 175 and 176, which project upwardly from the inside of front 106 of the housing. The base of prong 216 fits into slots 182 formed in ribs 176, 177.

The backbone 151 of strip 144 of the neutral bus assembly 118 is also press-fitted into longitudinal slot 174 (over backbone 141). The base of prong 218 rests in slots formed in ribs 175, 177.

The backbone 157 of the second strip 158 of the ground bus assembly 120 is press-fitted into space 172 between rib 176 and projection 171.

During assembly, the live, neutral and ground strips 116, 118 and 120 are inserted into respective slots 105 in pods 102, 104. The strips, connected by pods 102, 104, are inserted into cut-out regions 113, 114, with cut-outs 160 sliding upon ribs 162. Cover 110 includes tongues 109 in each corner, the tongues 109 are received in respective notches 111 located on each corner of front 106. When cover 110 is placed on front 106, tongues 109 mate with notches 111, the live, neutral and ground prongs 216, 218, 220 extend through apertures 122, 124, 126 respectively, to the pods 102, 104 are held between cover 110 to front 106. A plurality of screws 117 affix cover 110 and front 106. Cover 110 can also be provided with a dummy plug 125, the plastic prongs of which are received in another outlet.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An adapter for converting a single electrical outlet into a multiple electrical outlet, comprising:

a housing having a front having ribs forming prong-holding slots extending therefrom to within said housing, a back, and two opposed sides extending between the front and back, a first of said two opposed sides having a first cut-out portion;

a first pod positioned in said housing and having bus-receiving slots extending along said pod, said first pod being received in said first cut-out portion of said first of said two opposed sides and including at least one first socket, said first socket including a live prong receiving aperture and a neutral prong receiving aperture;

an electrically conductive live bus disposed in said housing and having a first live prong capable of being inserted into a live aperture in an electrical outlet and held by said prong-holding slots extending from the front of said housing, said live bus including at least one electrically conductive first live bus strip, said first live bus strip being supported by said bus-receiving slots extending along said first pod and extending along said first of said two opposed sides and adjacent said live prong receiving aperture of said first socket to electrically conductively engage a second live prong inserted into said live prong receiving aperture of said first socket; and an electrically conductive neutral bus disposed in said housing and having a first neutral prong being capable of being inserted into a neutral aperture of the electrical outlet and held by said prong-holding slots extending from the front of said housing, said neutral bus including at least one electrically conductive first neutral bus strip, said first neutral bus strip being supported by said buss-receiving slots extending along said first pod, said first neutral bus strip extending along said first of said two opposed sides adjacent said neutral prong receiving aperture of said first socket to electrically conductively engage a second neutral prong inserted into said neutral prong receiving aperture of said first socket.

2. The adapter of claim 1, wherein said first live bus strip is formed of a single piece of material.

3. The adapter of claim 1, wherein said first neutral bus strip is formed of a single piece of material.

4. The adapter of claim 1, further comprising a plurality of ribs disposed on said first neutral bus strip for gripping the second neutral prong inserted into the neutral prong receiving aperture of said first socket.

5. The adapter of claim 1, wherein said live bus further comprises an electrically conductive second live bus strip for supporting said first live prong, said first live prong being formed integrally with said second live bus strip.

6. The adapter of claim 5, wherein a second of said two opposed sides has a second cut-out portion, said adaptor further comprising:

a second pod positioned in said housing and having bus-receiving slots extending along said second pod, said second pod being received in said second cut-out portion in said second of said two opposed sides and including at least one second socket, said second socket including a live prong receiving aperture and a neutral prong receiving aperture;

a second one of said first live bus strips, said second one of said first live bus strips being supported by said bus-receiving slots extending along said second pod and extending along said second one of said two opposed sides and adjacent said live prong receiving aperture of said second socket of said second pod to electrically conductively engage a second live prong inserted into said live prong receiving aperture of said second socket;

wherein said second live bus strip extends between and connects each of said first live bus strips.

7. The adapter of claim 6, wherein the second live bus strip is formed of a single piece of metal and is connected to each of said first live bus strips at respective single connection points.

8. The adapter of claim 1, wherein said neutral bus further comprises an electrically conductive second neutral bus strip for supporting said first neutral prong, said first neutral prong being formed integrally with said second neutral bus strip.

9. The adapter of claim 8, wherein a second of said two opposed sides has a second cut-out portion, said adapter further comprising:

a second pod positioned in said housing and having bus-receiving slots extending along said second pod, said second pod being received in said second cut-out portion of said second of said two opposed sides and including at least one second socket, said second socket including a live prong receiving aperture and a neutral prong receiving aperture;

a second one of said first neutral bus strips, said second one of said first neutral bus strips being supported by said bus-receiving slots extending along said second pod and extending along said second one of said two opposed sides and adjacent said neutral prong receiving aperture of said second socket of said second pod to electrically conductively engage a second neutral prong inserted into said neutral prong receiving aperture of said second socket;

wherein said second neutral bus strip extends between and connects each of said first neutral bus strips.

10. The adapter of claim 9, wherein said second neutral bus strip is formed of a single piece of metal and is connected to each of said first neutral bus strips at respective single connection points.

11. The adapter of claim 1, wherein said first pod includes a plurality of tabs defining slots therebetween.

12. The adapter of claim 11, wherein said first live bus strip and said first neutral bus strip are each disposed in respective ones of said slots in said first pod.

13. The adapter of claim 11, further comprising a plurality of ribs disposed on said first live bus strip for gripping the second live prong inserted into the live prong receiving aperture of said first socket.

14. The adapter of claim 1, further comprising an electrically conductive ground bus disposed in said housing having a first ground prong capable of being inserted into a ground aperture in the electrical outlet, said first socket including a ground prong receiving aperture, said ground bus comprising an electrically conductive first ground bus strip extending along said first of said two opposed sides adjacent said ground prong receiving aperture to electrically conductively engage a second ground prong inserted into said ground prong receiving aperture of said first socket.

15. The adapter of claim 14, wherein said first ground bus strip is formed of a single piece of material.

16. The adapter of claim 14, further comprising a plurality of ribs disposed on said first ground bus strip for gripping the second ground prong inserted into the ground prong receiving aperture of said second socket.

17. The adapter of claim 14, further comprising an electrically conductive second ground bus strip for supporting said first ground prong.

18. The adapter of claim 17, wherein a second of the two opposed sides has a second cut-out portion, the adapter further comprising:

a second pod positioned in the housing and having bus-receiving slots extending along the pod, the second pod being received in the second cut-out portion of the second of the two opposed sides and including at least one second socket, the second socket including a live prong receiving aperture, a neutral prong receiving aperture, and a ground prong receiving aperture;

a second one of the first ground bus strips, the second one of the first ground bus strips being supported by the buss-receiving slots extending along the second pod, the second pod extending along the second one of the two opposed sides and adjacent the ground prong receiving aperture of the second socket of the second pod to electrically conductively engage a second ground prong inserted into the ground prong receiving aperture of the second socket;

wherein the second ground bus strip extends between and connects each of the first ground bus strips.

19. The adapter of claim 18, wherein said second ground bus strip is formed of a single piece of material and is connected to each of said first ground bus strips at respective single connection points.

* * * * *